US009445664B1

(12) United States Patent
Gapp

(10) Patent No.: US 9,445,664 B1
(45) Date of Patent: Sep. 20, 2016

(54) TABLE ASSEMBLY

(71) Applicant: Dale Gapp, Elk Point, SD (US)

(72) Inventor: Dale Gapp, Elk Point, SD (US)

( * ) Notice: Subject to any disclaimer, the term of this patent is extended or adjusted under 35 U.S.C. 154(b) by 0 days.

(21) Appl. No.: 14/663,599

(22) Filed: Mar. 20, 2015

(51) Int. Cl.

| | |
|---|---|
| ***A47B 85/00*** | (2006.01) |
| ***A47B 13/08*** | (2006.01) |
| ***A47B 13/00*** | (2006.01) |
| ***A47B 13/02*** | (2006.01) |
| ***A47B 13/16*** | (2006.01) |
| ***B63B 29/06*** | (2006.01) |
| *B63B 29/04* | (2006.01) |

(52) U.S. Cl.
CPC ..... *A47B 13/088* (2013.01); *A47B 13/003* (2013.01); *A47B 13/023* (2013.01); *A47B 13/16* (2013.01); *B63B 29/06* (2013.01); *B63B 2029/046* (2013.01)

(58) Field of Classification Search
CPC .. A47B 37/04; A47B 13/008; A47B 13/003; A47B 13/023; A47B 13/16; A45B 2200/1063; B63B 29/06; B63B 2029/046
USPC ..... 108/42, 25, 50.12; 135/16
See application file for complete search history.

(56) References Cited

U.S. PATENT DOCUMENTS

| | | | | | |
|---|---|---|---|---|---|
| 2,799,543 | A * | 7/1957 | Tomaselli | A45B 23/00 | 108/50.12 |
| 2,805,109 | A * | 9/1957 | Kopmar | A45B 23/00 | 108/25 |
| 3,620,174 | A * | 11/1971 | Dentino | A47B 13/08 | 108/151 |
| 4,086,859 | A | 5/1978 | Dondero | | |
| 4,672,898 | A | 6/1987 | Davidson | | |
| 4,708,256 | A * | 11/1987 | Intardonato | A47G 23/06 | 220/23.4 |
| 5,161,561 | A * | 11/1992 | Jamieson | A45B 3/00 | 108/94 |
| 5,197,394 | A * | 3/1993 | Schmidt | A45B 23/00 | 108/128 |
| 5,335,803 | A * | 8/1994 | O'Brien | A47B 13/14 | 108/50.12 |
| D367,841 | S | 3/1996 | Garelick | | |
| 5,595,128 | A | 1/1997 | De Ladurantaye et al. | | |
| 5,947,416 | A | 9/1999 | Kraft | | |
| 5,996,511 | A * | 12/1999 | Swoger | A47B 57/26 | 108/151 |
| 6,161,333 | A * | 12/2000 | Poston | A01G 9/02 | 47/86 |
| 6,477,966 | B1 * | 11/2002 | Petryna | A47B 37/04 | 108/11 |
| 6,663,057 | B2 | 12/2003 | Garelick et al. | | |
| D492,858 | S | 7/2004 | Georgopoulos | | |
| 7,155,860 | B1 * | 1/2007 | Ferguson, III | A01G 9/02 | 248/219.4 |
| 7,213,951 | B2 * | 5/2007 | Cowan | A47B 87/0246 | 211/153 |
| 7,389,738 | B1 | 6/2008 | Walczykowski | | |
| 7,458,331 | B2 | 12/2008 | Zsido | | |
| 8,136,458 | B1 * | 3/2012 | Cass | D06F 53/005 | 108/152 |
| 8,381,662 | B2 * | 2/2013 | Goldszer | A47B 37/04 | 108/25 |
| 8,397,648 | B1 * | 3/2013 | Palladino | A47B 37/04 | 108/42 |
| 8,720,349 | B1 * | 5/2014 | David | A47B 37/04 | 108/151 |
| 8,997,661 | B1 * | 4/2015 | Kilday | A47B 13/088 | 108/50.12 |
| 2005/0183638 | A1 * | 8/2005 | Lin | A47B 96/1425 | 108/51.11 |
| 2006/0240757 | A1 | 10/2006 | Sampson et al. | | |
| 2007/0246091 | A1 * | 10/2007 | Becker | A45B 3/00 | 135/16 |
| 2009/0189035 | A1 * | 7/2009 | Gambill | A45B 23/00 | 248/218.4 |
| 2010/0163086 | A1 * | 7/2010 | Chavez | A45B 3/00 | 135/16 |
| 2011/0278248 | A1 * | 11/2011 | Pron | A45B 3/00 | 211/107 |
| 2015/0122157 | A1 * | 5/2015 | Cote | A01K 39/014 | 108/24 |

* cited by examiner

*Primary Examiner* — Jose V Chen

(57) ABSTRACT

A table assembly includes a table that has a top surface, a bottom surface and a peripheral edge extending between the top surface and the bottom surface. The table is structured to be split in half. A coupler is attached to the table and the coupler may insertably receive an end of a seat pedestal in a boat wherein the table is supported on the seat pedestal. A lock is provided to retain the coupler on the seat pedestal.

15 Claims, 4 Drawing Sheets

TABLE ASSEMBLY

BACKGROUND OF THE DISCLOSURE

Field of the Disclosure

The disclosure relates to table devices and more particularly pertains to a new table device for being removably positioned within a boat.

SUMMARY OF THE DISCLOSURE

An embodiment of the disclosure meets the needs presented above by generally comprising a table that has a top surface, a bottom surface and a peripheral edge extending between the top surface and the bottom surface. The table is structured to be split in half. A coupler is attached to the table and the coupler may insertably receive an end of a seat pedestal in a boat wherein the table is supported on the seat pedestal. A lock is provided to retain the coupler on the seat pedestal.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
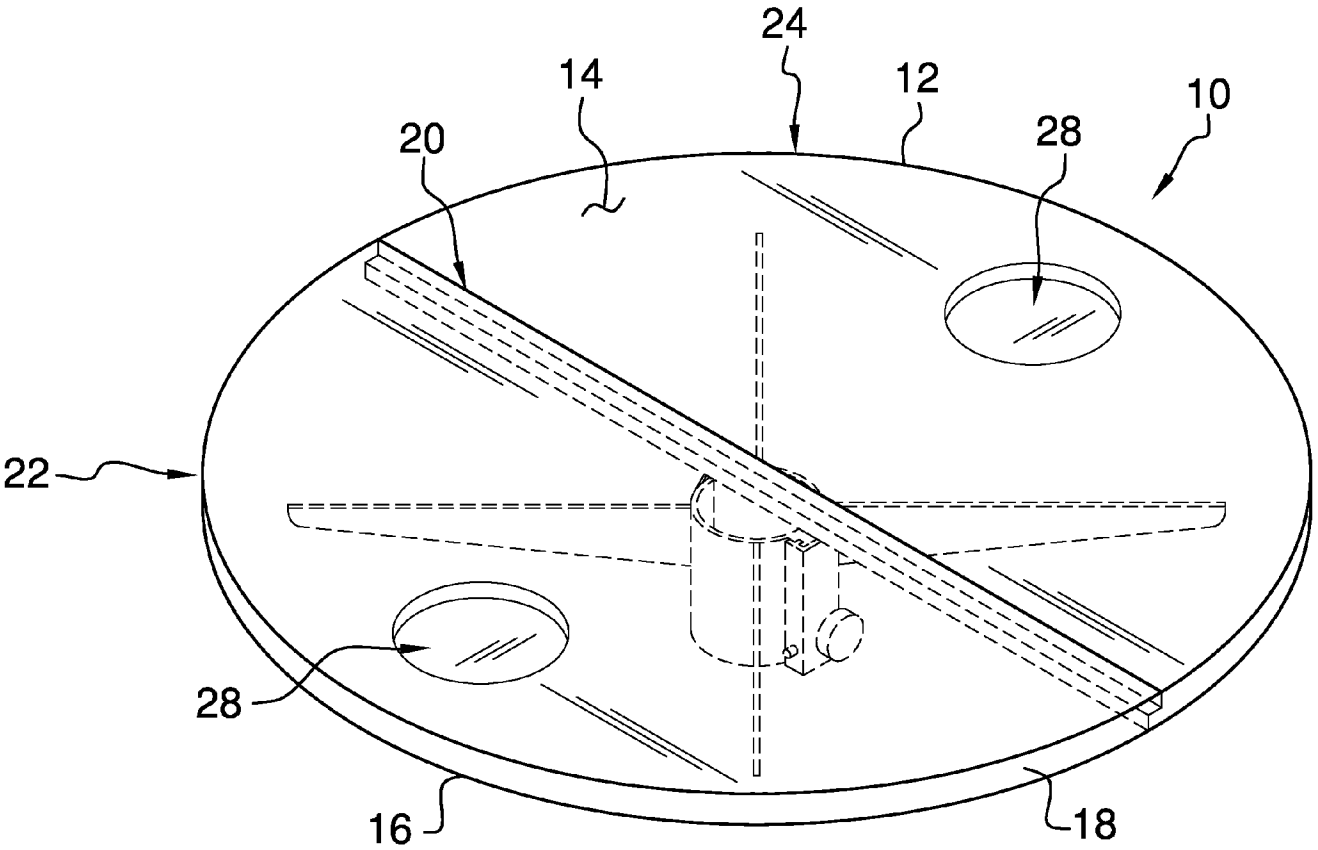
FIG. 1 is a top perspective phantom view of a table assembly according to an embodiment of the disclosure.
Figure 2:
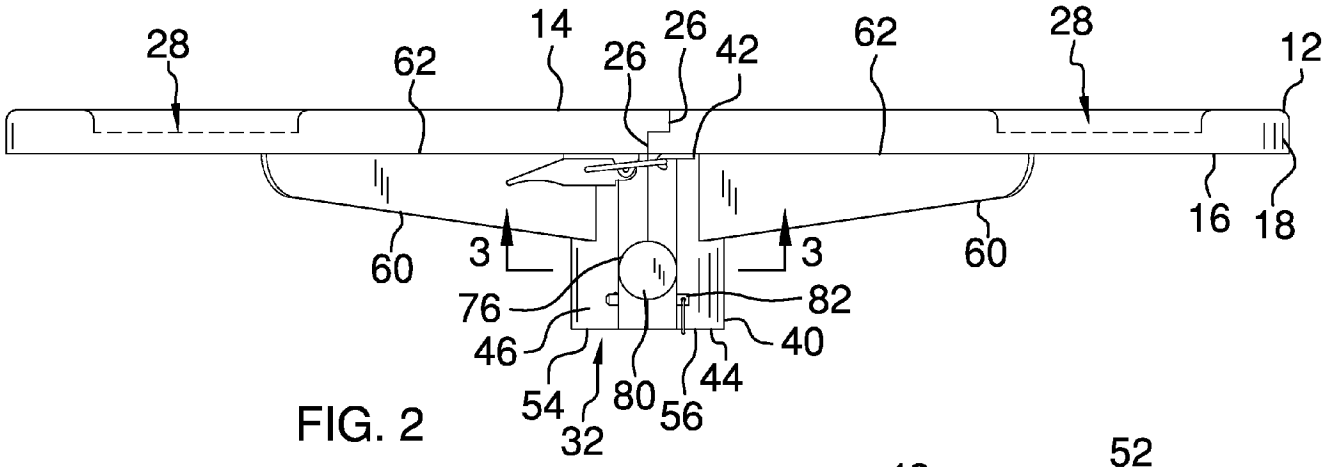
FIG. 2 is a left side view of an embodiment of the disclosure.
Figure 3:
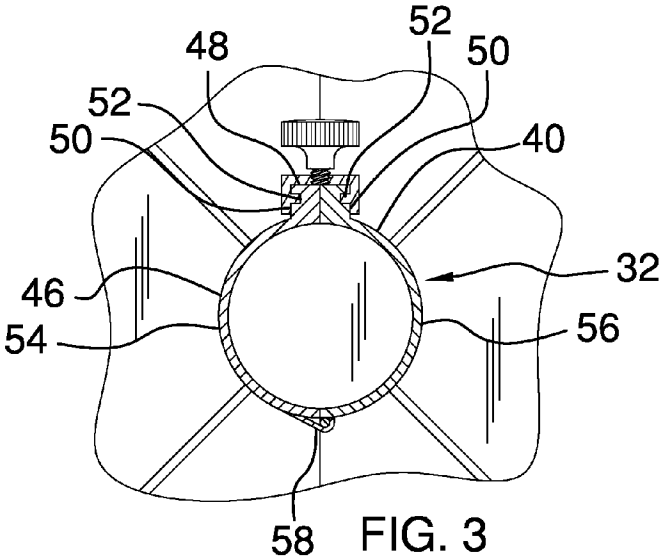
FIG. 3 is a bottom view of an embodiment of the disclosure.
Figure 4:
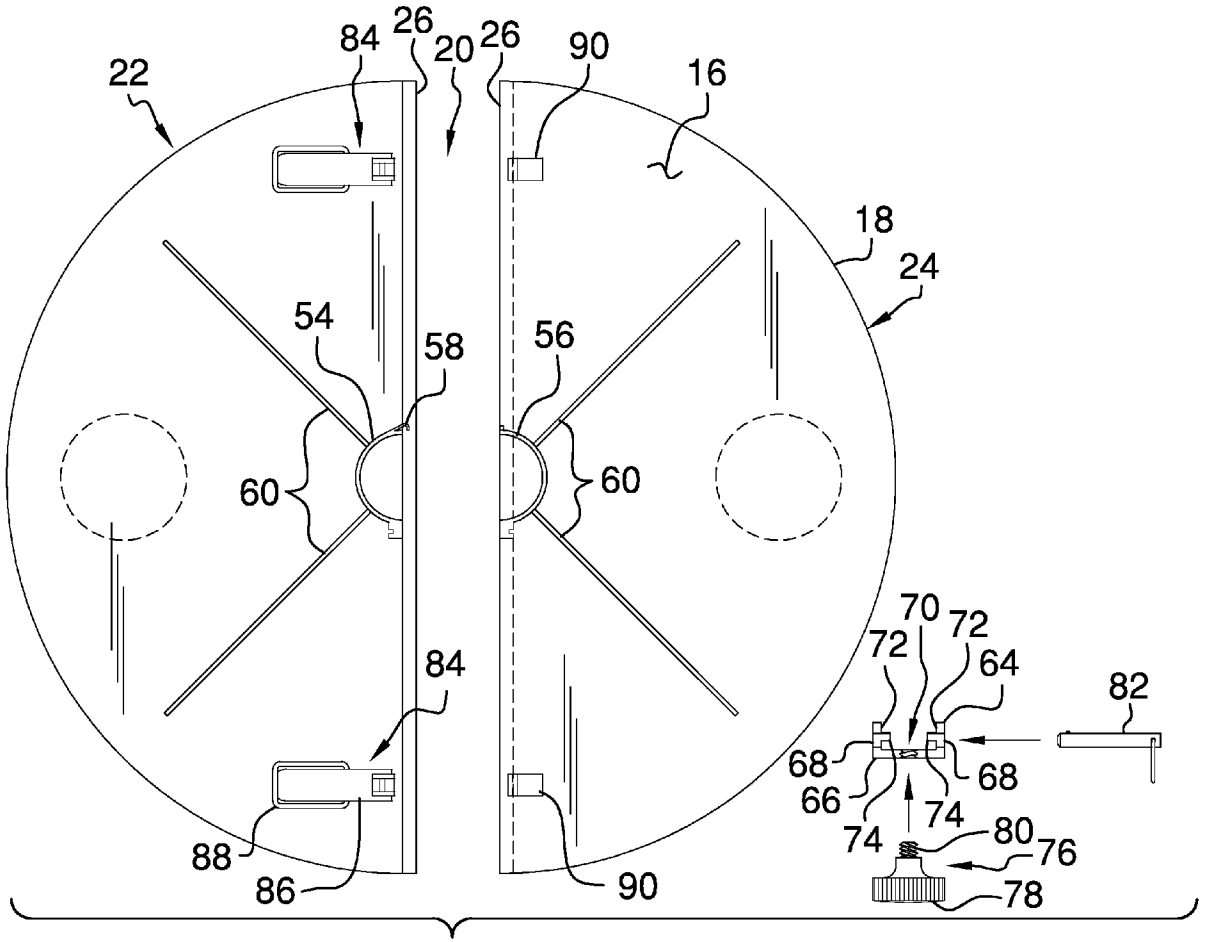
FIG. 4 is a bottom perspective view of an embodiment of the disclosure.
Figure 5:
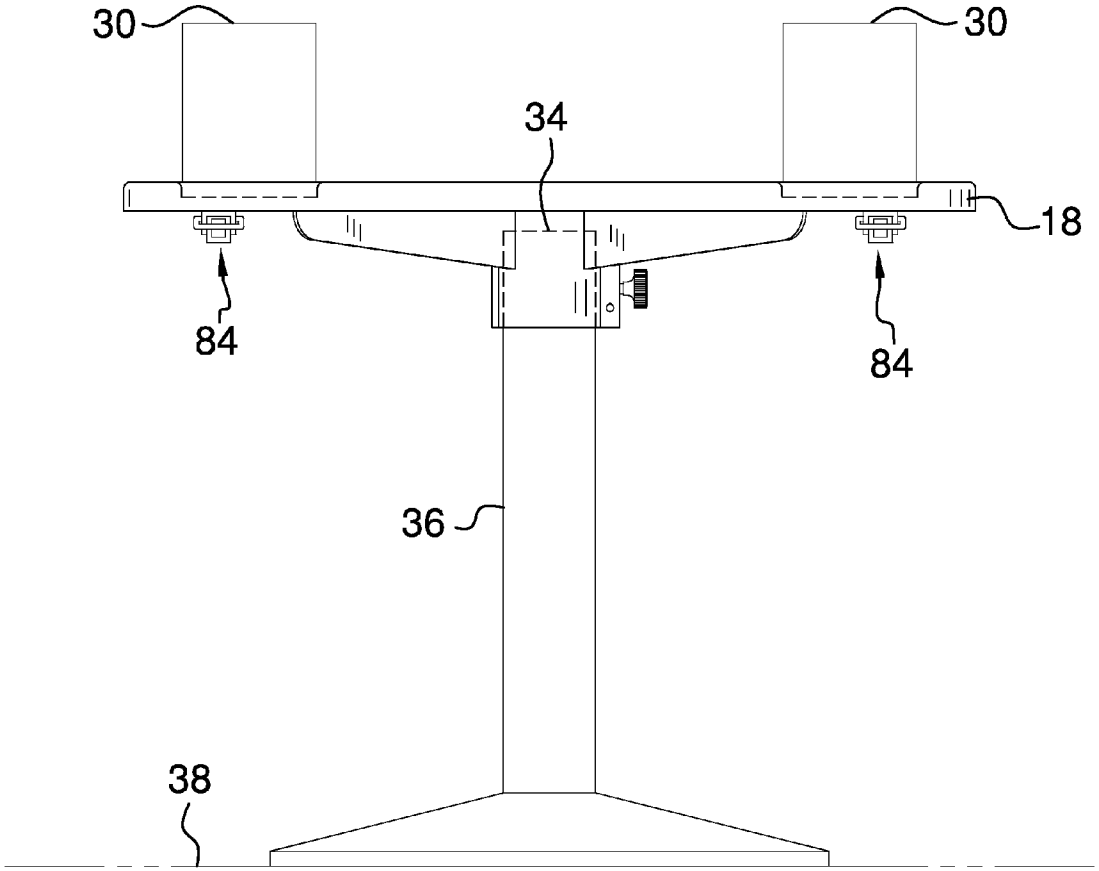
FIG. 5 is a perspective in-use view of an embodiment of the disclosure.

With reference now to the drawings, and in particular to FIGS. 1 through 5 thereof, a new table device embodying the principles and concepts of an embodiment of the disclosure and generally designated by the reference numeral 10 will be described.

As best illustrated in FIGS. 1 through 5, the table assembly 10 generally comprises a table 12 that has a top surface 14, a bottom surface 16 and a peripheral edge 18 extending between the top surface 14 and the bottom surface 16. The peripheral edge 18 is arcuate such that the table 12 has a circular shape and the table 12 has a cut 20 extending through the top surface 14 and the bottom surface 16. The cut 20 is centrally positioned on the table 12 and extends across an entire width of the table 12 such that the cut 20 bisects the table into a first half 22 and a second half 24.

The cut 20 defines a mating edge 26 on each of first half 22 and the second half 24. The mating edge 26 of the first half 22 is recessed adjacent to the bottom surface 16 and the mating edge 26 of the second half 24 is recessed adjacent to the top surface 14. The mating surface 26 on the first half 22 engages the mating surface 26 on the second half 24 thereby facilitating each of the top surface 14 and the bottom surface 16 of the first half 22 to be oriented planar with an associated one of the top surface 14 and the bottom surface 16 of the second half 24.

The top surface 14 has a pair of wells 28 extending toward the bottom surface 16 and each of the wells 28 is positioned adjacent to the peripheral edge 18. Each of the wells 28 is positioned on an associated one of the first half 22 and the second half 24 and each of the wells 28 may insertably receive an object 30. The object 30 may be a beverage container or the like.

A coupler 32 is attached to the table 12 and the coupler 32 may insertably receive an end 34 of a seat pedestal 36 in a boat 38 wherein the table 12 is supported on the seat pedestal 36. The boat 38 may be a boat of any conventional design. The coupler comprises a sleeve 40 that has a top end 42, a bottom end 44 and a perimeter wall 46 extending between the top end 42 and the bottom end 44. Each of the top end 42 and the bottom end 44 are open and the sleeve 40 is substantially hollow. The top end 42 is attached to the bottom surface 16 of the table 12 and the bottom end 44 of the sleeve 40 insertably receives the end 34 of the seat pedestal 36.

The sleeve 40 has an extended portion 48 extending outwardly from the perimeter wall 46 and the extended portion 48 extends between the top end 42 and the bottom end 44. The extended portion 48 has a pair of outwardly facing surfaces 50 and each of the outwardly facing surfaces 50 has a groove 52 extending inwardly therein. The groove 52 in each of the outwardly facing surfaces 50 extends between the top end 42 and the bottom end 44.

The perimeter wall 46 is split between the top end 42 and the bottom end 44 to define a primary half 54 of the sleeve 40 and a secondary half 56 of the sleeve 40. Each of the primary half 54 and the secondary half 56 is aligned with the cut 20 in the table 12 such that the sleeve 40 forms a cylinder when the first half 22 and the second half 54 are mated. The perimeter wall 46 corresponding to the primary half 54 has a clip 58 attached thereto and the clip 58 engages the secondary half 56 when the first half 22 and the second half 54 are mated. The bottom end 44 may insertably receive the end 34 of the seat pedestal 36 in the boat 38.

A plurality of supports 60 is provided and each of the supports 60 is coupled to and extends away from the perimeter wall 46 of the sleeve 40. The supports 60 are radially distributed around the sleeve 40 and each of the supports 60 has a top edge 62. The top edge 62 of each of the supports 60 is attached to the bottom surface 16 and each of the supports 60 supports the table 12 when the sleeve 40 receives the seat pedestal 36.

A retainer 64 is provided that has a central wall 66 and a pair of lateral walls 68. Each of the lateral walls 68 is attached to and extends away from the central wall 66 and each of the lateral walls 68 is spaced apart from each other to define a channel 70 in the retainer 64. Each of the lateral walls 68 has an inwardly facing surface 72 and the inwardly facing surface 72 of each of the lateral walls 68 has a tab 74 attached thereto. The channel 70 insertably receives the extended portion 48 of the sleeve 40 when the first half 22 and the second half 24 are mated together. Thus, the tab 74 on each of the inwardly facing surfaces 72 engages an associated one of the grooves 52 in the extended portion 48.

A lock 76 is provided that includes a knob 78 and a shaft 80 coupled to and extending away from the knob 78. The shaft 80 extends through the central wall 66 of the retainer 64 and the extended portion 48 of the sleeve 40 when the retainer 64 is positioned on the sleeve 40. The shaft 80 may engage the seat pedestal 36 when the seat pedestal 36 is inserted into the bottom end 44 of the sleeve 40 thereby inhibiting the table 12 from spinning on the seat pedestal 36. A pin 82 is removably extended through the retainer 64 and the extended portion 48 when the retainer 64 is placed on the extended portion 48. The pin 82 retains the retainer 64 on the extended portion 48.

A pair of latches 84 is provided and each of the latches 84 is coupled to the bottom surface 16 corresponding to the first half 22. Each of the latches 84 includes a handle 86 and a loop 88 movably attached to the handle 86. A pair of hooks 90 is provided and each of the hooks 90 is coupled to the bottom surface 16 corresponding to the second half 24. The loop 88 on each of the latches 84 engages an associated one of the hooks 90 when the first half 22 and the second half 24 are mated. The handle 86 is urged toward the bottom surface 16 when the loop 88 engages the associated hook 90. Thus, the latches 84 urge each of the mating edges 26 toward each thereby retaining the first half 22 on the second half 24.

In use, the mating edge 26 of each of the first half 22 and the second half 24 is abutted against each other. The loop 88 on each of the latches 84 is positioned to engage an associated one of the hooks 90 in order to couple the first half 22 and the second half 24 together. The retainer 64 is slid onto the extended portion 48 of the sleeve 40 and the pin 82 is extended through the retainer 64. The bottom end 44 of the sleeve 40 insertably receives the end 34 of the seat pedestal 36 and the knob 78 on the lock 76 is rotated thereby facilitating the shaft 80 to engage the seat pedestal 36.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A table assembly configured to be removably installed in a boat, said assembly comprising:

a table having a top surface, a bottom surface and a peripheral edge extending between said top surface and said bottom surface, said table being structured to be split in half;

a coupler attached to said table, said coupler being configured to insertably receive an end of a seat pedestal in a boat wherein said table is supported on the seat pedestal;

a lock being configured to retain said coupler on the seat pedestal;

wherein said coupler comprises a sleeve having a top end, a bottom end and a perimeter wall extending between said top end and said bottom end, each of said top end and said bottom end being open, said sleeve being substantially hollow, said top end being attached to said bottom surface of said table; and wherein said sleeve has an extended portion extending from said perimeter wall, said extended portion extending a full length between said top end and said bottom end, said extended portion having a pair of outwardly facing surfaces relative to each other, each of said outwardly facing surfaces having a groove extending inwardly therein, each said groove extending a full length of said extended portion between said top end and said bottom end.

2. The assembly according to claim 1, wherein said peripheral edge is arcuate such that said table has a circular shape, said table having a cut extending through said top surface and said bottom surface, said cut being centrally positioned on said table and extending across an entire width of said table such that said cut bisects said table into a first half and a second half.

3. The assembly according to claim 2, wherein said cut defines a mating edge on each of first half and said second half, said mating edge of said first half being recessed adjacent to said bottom surface, said mating edge of said second half being recessed adjacent to said top surface.

4. The assembly according to claim 3, wherein said mating surface on said first half engages said mating surface on said second half such that said each of said top surface and said bottom surface of said first half are oriented to be planar with an associated one of said top surface and said bottom surface of said second half.

5. The assembly according to claim 1, wherein said top surface has a pair of wells extending toward said bottom surface, each of said wells being positioned adjacent to said peripheral edge, each of said wells being positioned on an associated one of said first half and said second half, each of said wells being configured to insertably receive an object.

6. The assembly according to claim 1, wherein:

said table has a cut, said cut defining a first half and a second half of said table; and said perimeter wall is split between said top end and said bottom end to define a primary half of said sleeve and a secondary half of said sleeve, each of said primary half and said secondary half being aligned with said cut in said table such that said sleeve forms a cylinder when said first half and said second half are mated.

7. The assembly according to claim 6, wherein said perimeter wall corresponding to said primary half has a clip attached thereto, said clip engaging said secondary half when said first half and said second half are mated, said bottom end being configured to insertably receive the end of the seat pedestal in the boat.

8. The assembly according to claim 7, further comprising a plurality of supports, each of said supports being coupled to and extending away from said perimeter wall, said supports being radially distributed around said sleeve, each of said supports having a top edge, said top edge of each of said supports being attached to said bottom surface, each of said supports supporting said table when said sleeve receives the seat pedestal.

9. The assembly according to claim 1, further comprising a retainer having a central wall and a pair of lateral walls, each of said lateral walls being attached to and extending away from said central wall, each of said lateral walls being spaced apart from each other to define a channel in said retainer, each of said lateral walls having an inwardly facing surface, said extended portion of said sleeve being inserted into and positioned within said channel.

10. The assembly according to claim 9, wherein:

said inwardly facing surface of each of said lateral walls has a tab attached thereto, said channel insertably receiving said extended portion of said coupler when said first half and said second half are mated together such that said tab on each of said inwardly facing surfaces engages an associated one of said grooves in said extended portion.

11. The assembly according to claim 10, wherein said lock includes a knob and a shaft coupled to and extending away from said knob, said shaft extending through said central wall of said retainer and said extended portion of said coupler when said retainer is positioned on said coupler, said shaft being configured to engage the seat pedestal when the seat pedestal is inserted into said bottom end of said coupler thereby inhibiting said table from spinning on the seat pedestal.

12. The assembly according to claim 9, further comprising a pin removably extended through said retainer and said extended portion when said retainer is placed on said extended portion, said pin retaining said retainer on said extended portion.

13. The assembly according to claim 1, further comprising:

said table having a first half and a second half, said first half and said second half being matable; and a pair of latches, each of said latches being coupled to said bottom surface corresponding to said first half, each of said latches including a handle and a loop movably attached to said handle.

14. The assembly according to claim 13, wherein a pair of hooks, each of said hooks being coupled to said bottom surface corresponding to said second half, said loop on each of said latches engaging an associated one of said hooks when said first half and said second half are mated thereby retaining said first half on said second half.

15. A table assembly configured to be removably installed in a boat, said assembly comprising:

a table having a top surface, a bottom surface and a peripheral edge extending between said top surface and said bottom surface, said peripheral edge being arcuate such that said table has a circular shape, said table having a cut extending through said top surface and said bottom surface, said cut being centrally positioned on said table and extending across an entire width of said table such that said cut bisects said table into a first half and a second half, said cut defining a mating edge on each of first half and said second half, said mating edge of said first half being recessed adjacent to said bottom surface, said mating edge of said second half being recessed adjacent to said top surface, said mating surface on said first half engaging said mating surface on said second half such that said each of said top surface and said bottom surface of said first half are oriented to be planar with an associated one of said top surface and said bottom surface of said second half, said top surface having a pair of wells extending toward said bottom surface, each of said wells being positioned adjacent to said peripheral edge, each of said wells being positioned on an associated one of said first half and said second half, each of said wells being configured to insertably receive an object;

a coupler attached to said table, said coupler being configured to insertably receive an end of a seat pedestal in a boat wherein said table is supported on the seat pedestal, said coupler comprising a sleeve having a top end, a bottom end and a perimeter wall extending between said top end and said bottom end, each of said top end and said bottom end being open, said sleeve being substantially hollow, said top end being attached to said bottom surface of said table, said sleeve having an extended portion extending from said perimeter wall, said extended portion extending a full length between said top end and said bottom end, said extended portion having a pair of outwardly facing surfaces relative to each other, each of said outwardly facing surfaces having a groove extending inwardly therein, each said groove extending a full length between said top end and said bottom end, said perimeter wall being split between said top end and said bottom end to define a primary half of said sleeve and a secondary half of said sleeve, each of said primary half and said secondary half being aligned with said cut in said table such that said sleeve forms a cylinder when said first half and said second half are mated, said perimeter wall corresponding to said primary half having a clip attached thereto, said clip engaging said secondary half when said first half and said second half are mated, said bottom end being configured to insertably receive the end of the seat pedestal in the boat, and a plurality of supports, each of said supports being coupled to and extending away from said perimeter wall, said supports being radially distributed around said sleeve, each of said supports having a top edge, said top edge of each of said supports being attached to said bottom surface, each of said supports supporting said table when said sleeve receives the seat pedestal, a retainer having a central wall and a pair of lateral walls, each of said lateral walls being attached to and extending away from said central wall, each of said lateral walls being spaced apart from each other to define a channel in said retainer, each of said lateral walls having an inwardly facing surface, said inwardly facing surface of each of said lateral walls having a tab attached thereto, said channel insertably receiving said extended portion of said coupler when said first half and said second half are mated together such that said tab on each of said inwardly facing surfaces engages an associated one of said grooves in said extended portion;

a lock, said lock including a knob and a shaft coupled to and extending away from said knob, said shaft extending through said central wall of said retainer and said extended portion of said coupler when said retainer is positioned on said coupler, said shaft being configured to engage the seat pedestal when the seat pedestal is inserted into said bottom end of said coupler thereby inhibiting said table from spinning on the seat pedestal;

a pin removably extended through said retainer and said extended portion when said retainer is placed on said extended portion, said pin retaining said retainer on said extended portion;

a pair of latches, each of said latches being coupled to said bottom surface corresponding to said first half, each of said latches including a handle and a loop movably attached to said handle; and a pair of hooks, each of said hooks being coupled to said bottom surface corresponding to said second half, said loop on each of said latches engaging an associated one of said hooks when said first half and said second half are mated thereby retaining said first half on said second half.

* * * * *